US005913288A

United States Patent [19]

Mickel et al.

[11] Patent Number: 5,913,288

[45] Date of Patent: Jun. 22, 1999

[54] DUAL DRUM BOILER

[75] Inventors: James L. Mickel, Camp Hill; Roderick G. Strohl, Annville; Glenn R. Sward, Lancaster, all of Pa.

[73] Assignee: Burnham Corporation, Lancaster, Pa.

[21] Appl. No.: 09/046,463

[22] Filed: Mar. 23, 1998

[51] Int. Cl.[6] ..... F22B 7/12

[52] U.S. Cl. ..... 122/149; 122/235.15

[58] Field of Search ..... 122/6 A, 74, 75, 122/110, 147, 149, 182.1, 182.2, 235.15, 17

[56] References Cited

U.S. PATENT DOCUMENTS

| | | | |
|---|---|---|---|
| 2,262,194 | 11/1941 | Newton . | |
| 2,557,368 | 6/1951 | Broderick . | |
| 3,168,243 | 2/1965 | Porland . | |
| 3,477,411 | 11/1969 | Gething | 122/149 |
| 3,848,573 | 11/1974 | Phillips . | |
| 4,195,596 | 4/1980 | Scheifley et al. | 122/149 |
| 4,838,210 | 6/1989 | Kirby | 122/75 |
| 4,860,695 | 8/1989 | Korenberg . | |
| 4,920,925 | 5/1990 | Korenberg et al. | 122/182.2 |
| 4,989,549 | 2/1991 | Korenberg . | |
| 5,029,557 | 7/1991 | Korenberg . | |
| 5,590,832 | 1/1997 | Fiedrich . | |

*Primary Examiner*—Teresa Walberg
*Assistant Examiner*—Gregory A. Wilson
*Attorney, Agent, or Firm*—Howson and Howson

[57] ABSTRACT

A long-lasting hot water boiler. The boiler has a lower drum with a first pass fire-tube for generating combustion gases, an upper drum with a second pass fire-tube bundle for the gaseous products of combustion, and a lined fire reversing chamber for directing the gaseous products from the first pass to the second pass. The reversing chamber liner includes a saddle piece and a turnaround piece which cooperate to protect vulnerable weld joints adjacent the reversing chamber and which maintain proper positioning even after weld pins melt. The upper and lower drums are interconnected by an expansion joint which permits unequal thermal expansion of the drums, and a bypass circulation system prevents thermal shocking of the boiler.

18 Claims, 4 Drawing Sheets

DUAL DRUM BOILER

FIELD OF THE INVENTION

The present invention relates to a self-contained commercial boiler, and more particularly, the present invention relates to a commercial hot water boiler having a first pass fire-tube, a set of second pass fire-tubes and a fire reversing chamber constructed in a manner which resists damage from thermal shock.

BACKGROUND OF THE INVENTION

A hot water boiler comprises an integral part of a heating system of a building structure and is used to heat a fluid, such as water, circulating at high temperatures through hydronic piping and radiator/convector heating systems. Gaseous or liquid fuels are ignited within the boiler to generate heat which is transferred to the circulating water which is completely isolated from the outside environment. The heated water exits the boiler, transfers the heat throughout the building, and returns to the boiler for reheating. The spent combustion gas is exhausted into the atmosphere.

One type of boiler, referred to as a "modified Scotch boiler" in the present assignee's U.S. Pat. No. 4,838,210 issued to Kirby, has a burner which is located at the front of the boiler, combusts fuel within a horizontally-disposed fire-tube, and forces the combustion gases toward the rear of the boiler in a first pass. At the rear of the boiler, a fire reversing chamber reverses the flow of the gases toward the front of the boiler through a set of second pass fire-tubes located above the first pass fire-tube. The combustion gases travel back to the rear of the boiler in third pass fire-tubes, and then, are exhausted into the atmosphere. The Kirby patent discloses lining a back portion of the reversing chamber with a replaceable, one-piece, refractory liner.

U.S. Pat. Nos.: 3,848,573 issued to Phillips; 4,195,596 issued to Scheifley et al.; 5,029,557 issued to Korenberg; 4,860,695 issued to Korenberg; 4,920,925 issued to Korenberg et al.; and 4,989,549 issued to Korenberg disclose examples of other boilers having a first pass fire-tube, at least one reversing chamber, and a second pass fire-tube bundle.

Many forces acting on such boilers can reduce the life of the boilers. For instance, thermal shocking of boiler heating surfaces can result from the introduction of cold system return water into a hot boiler. Some boiler designers attempt to prevent thermal shocking by utilizing bypass circulation systems as disclosed in U.S. Pat. Nos.: 5,590,832 issued to Fiedrich; 2,557,368 issued to Broderick; 2,262,194 issued to Newton; and 3,168,243 issued to Porland. Other examples of detrimental forces which can reduce the life of a boiler include the stress and strain concentrated on the weld joints of the boiler frame due to unequal expansion of different boiler components and excess radiant heat within the boiler exposed to various weld joints of the boiler.

Although various ones of the above-referenced boilers may be satisfactory for their intended purposes, there is a need for an improved boiler construction capable of withstanding the various thermal forces acting on the boiler such as, thermal shocking, to prolong the life of the boiler. The boiler should optimize combustion, increase heat transfer, and operate efficiently, and the boiler manufacturing and installation costs should provide savings over existing boiler designs.

OBJECTS OF THE INVENTION

With the foregoing in mind, a primary object of the present invention is to provide a novel boiler configuration which is resistant to thermal shocking and other detrimental thermal forces.

Another object of the present invention is to provide a boiler having a reversing chamber with a protective liner which protects all adjacent weld joints from excess radiant heat and which is held in position in the reversing chamber in a unique manner.

A further object of the present invention is to provide a boiler constructed with an expansion joint which accommodates unequal thermal expansion of various boiler components without generating and concentrating stress and strain at the weld joints of the boiler frame.

A still further object of the present invention is to provide a boiler with thermal shock protection.

A still further object of the present invention is to provide an improved long-lasting boiler which is relatively inexpensive to manufacture and install.

SUMMARY OF THE INVENTION

More specifically, the present invention provides a boiler having a first pass fire-tube, a set of second pass fire-tubes held in position by a fire-tubesheet, and a fire reversing chamber connecting the passes for reversing the flow of combustion gases between the passes. The reversing chamber has a replaceable refractory liner which covers an end portion of the first pass fire-tube adjacent the reversing chamber and an outer perimeter of the fire-tubesheet. Other aspects of the present invention include an expansion joint on the front frame of the boiler and an external fluid bypass circulation system.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
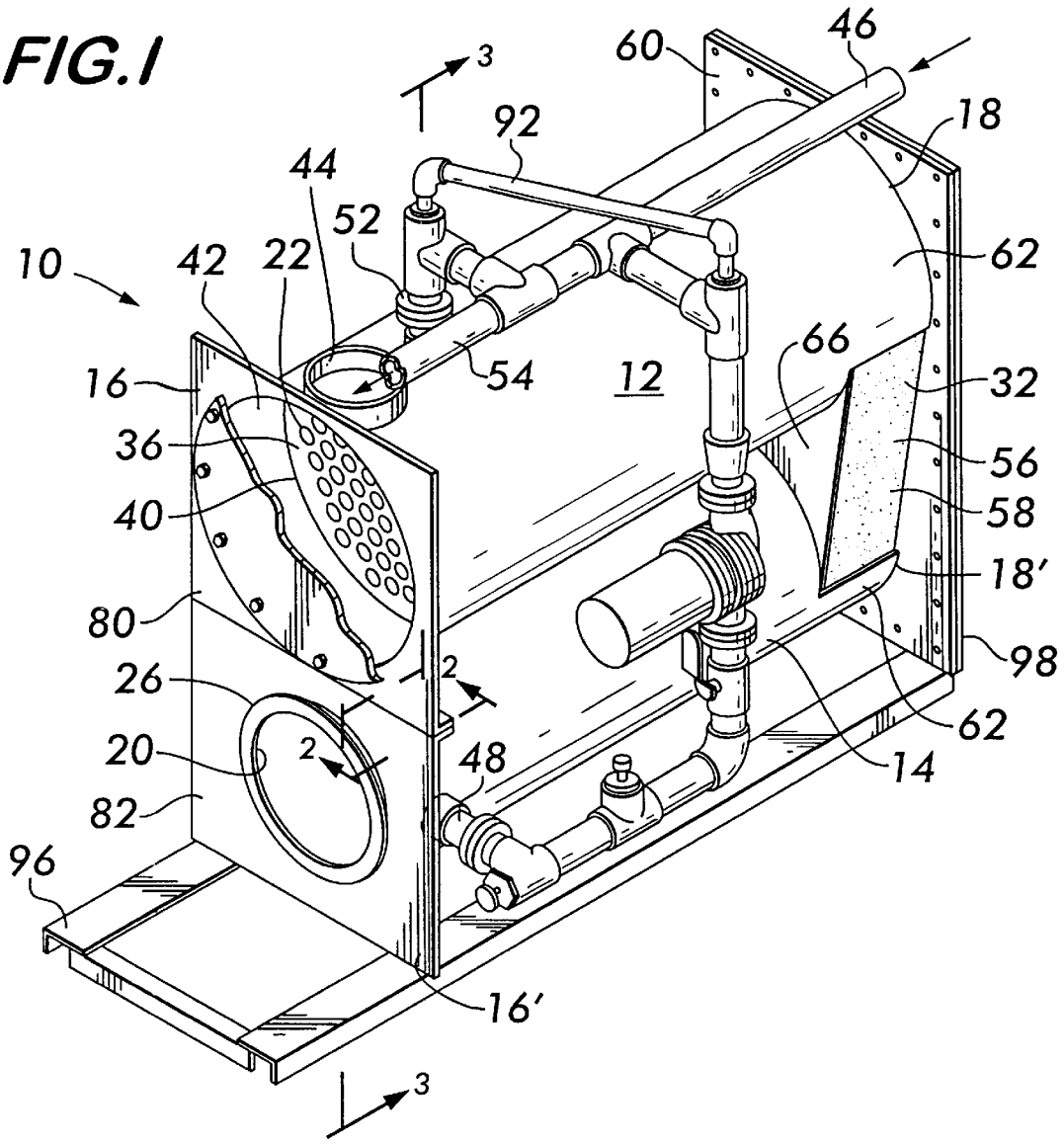
FIG. 1 is a perspective view of a dual drum boiler embodying the present invention.

The present invention provides a dual drum boiler 10 capable of heating a fluid which flows into, through, and out of the boiler 10 and which circulates through a hydronic piping and radiator/convector heating system (not shown). The boiler 10 has a horizontally-disposed lower drum 14 mounted on a base frame 96 and a horizontally-disposed upper drum 12 centered above and connected to the lower drum 14. The drums 12 and 14 have front ends, 16 and 16', and rear ends, 18 and 18', respectively. As will be discussed in detail, a burner (not shown) adjacent the front end 16' of the lower drum 14 combusts a gaseous or liquid fuel and the gaseous products of combustion make a first pass between the ends 16' and 18' of the lower drum 14 and a second pass between the ends 18 and 16 of the upper drum 12 in the boiler 10 transferring the energy of combustion to fluid present in drums 12 and 14.

Both drums 12 and 14 provide separate and isolated fluid tight paths for the fluid and for the gaseous products of combustion so that the energy of the combustion is transferred in a highly efficient manner to the fluid. To this end, a cylindrical fire-tube 20 extends concentrically within the cylindrical lower drum 14, and a fire-tube bundle 22 extends within the cylindrical upper drum 12.

Figure 3:
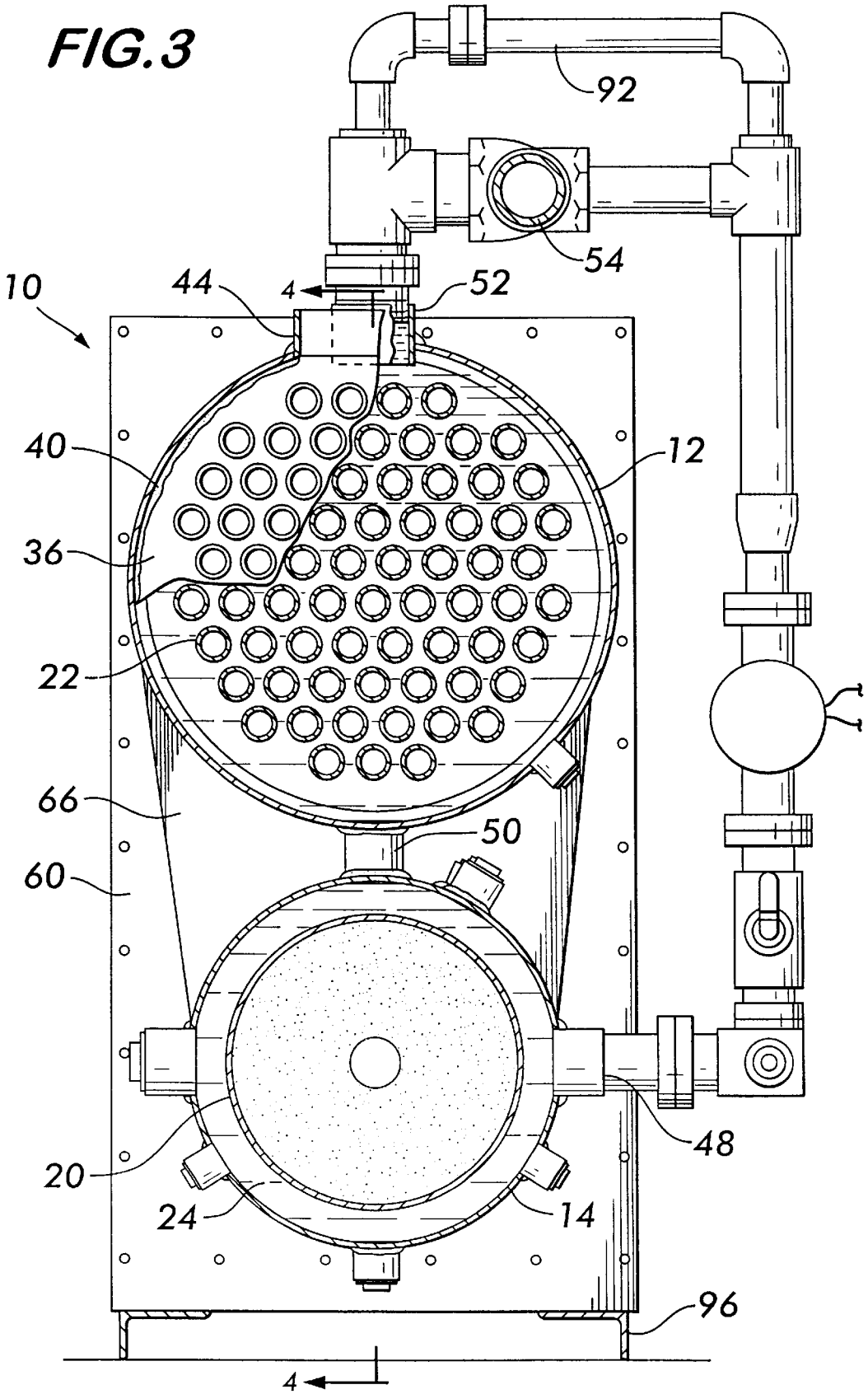
FIG. 3 is a cross-sectional view of the boiler taken on line 3—3 of FIG. 1.

As best illustrated in FIG. 3, a narrow annular space 24 is provided between the fire-tube 20 and the lower drum 14 so that fluid located in the annular space 24 surrounds the fire-tube 20 along its entire length. The burner (not shown) communicates with the fire-tube 20 adjacent the front end 16' of the lower drum 14 to cause complete combustion of the fuel within the fire-tube 20. Heat from combustion in the fire-tube 20 is transferred to the fluid in the annular space 24 as the gaseous products of combustion travel in a first pass toward the rear end 18' of the lower drum 14. The fire-tube 20 is connected to the lower drum 14 by a fluid tight annular weld joint 26 adjacent the front end 16' of the lower drum 14 and a fluid tight annular weld joint 28 adjacent the rear end 18' of the lower drum 14. An end portion 30 of the fire-tube 20 directs the gaseous products of combustion from the first pass into a fire reversing chamber 32 which is located at the rear ends 18 and 18' of the drums, 12 and 14.

The reversing chamber 32 directs the gases into the fire-tube bundles 22 in the upper drum 12 for a second pass through the boiler 10. To this end, the fire-tubes 22 extend continuously between and are connected to a pair of upstanding tubesheets 34 and 36 which retain the fire-tubes 22 in spaced parallel relation. The tubesheet 34 is connected to the upper drum 12 adjacent the rear end 18 of the upper drum 12 by a fluid tight annular weld joint 38, and the tubesheet 36 is connected a spaced distance from the front end 16 of the upper drum 12 by a fluid tight annular weld joint 40. Thus, gaseous products of combustion communicating from the fire reversing chamber 32 flow through the fire-tubes 22 toward the front end 16 of the upper drum 12 to transfer heat to the fluid which is located in the upper drum 12 and which surrounds each fire-tube in the tube bundle 22.

After the efficient transfer of heat in the first and second passes, the spent gases exit the second pass into an outlet chamber 42 located in the front end 16 of the upper drum 12. The spent gases are vented out of the boiler 10 through a spent gas outlet 44 located directly above the outlet chamber 42 on the upper drum 12.

Figure 4:
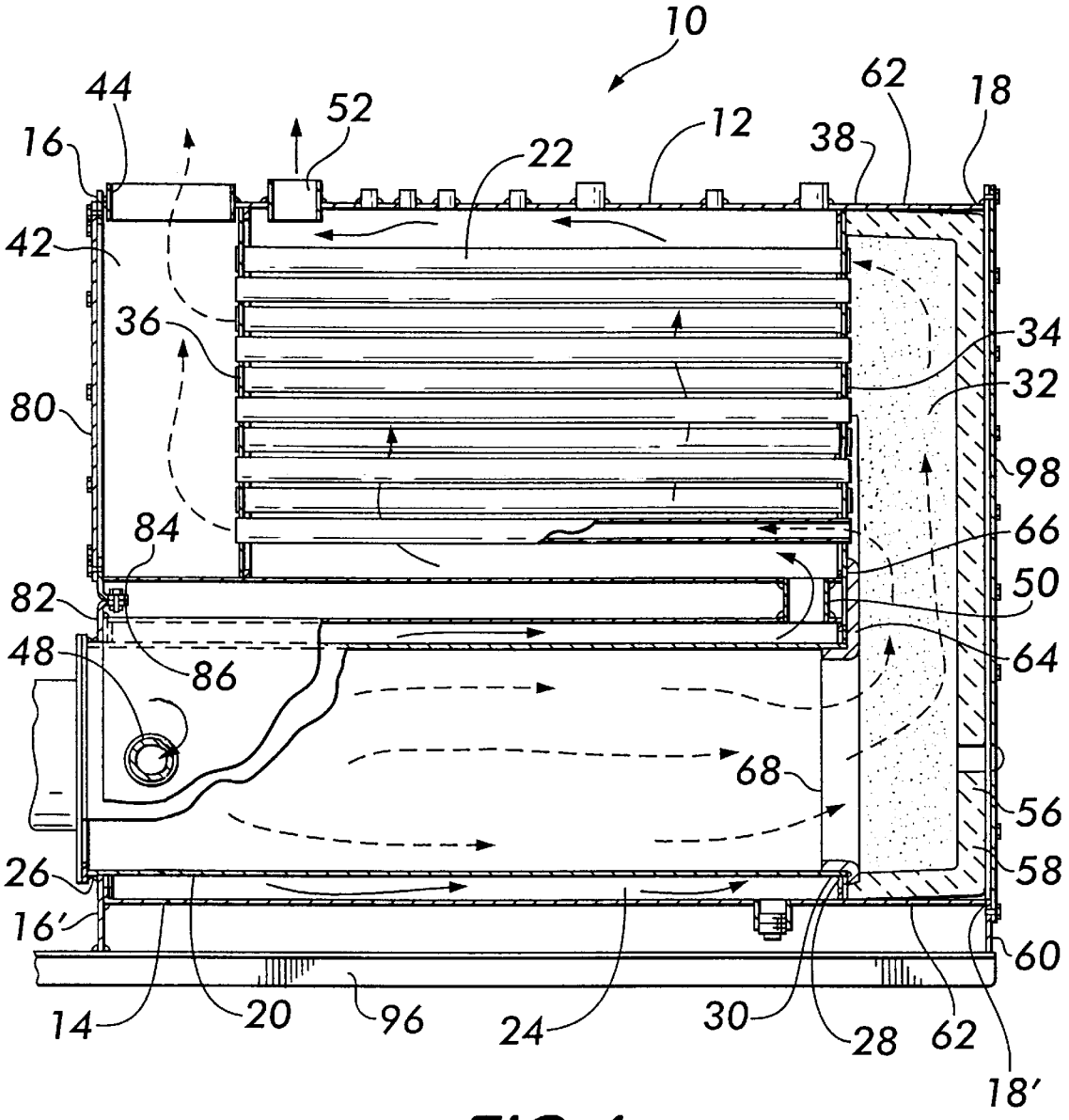
FIG. 4 is a cross-sectional view of the boiler taken on line 4—4 of FIG. 3.

The fluid, although completely isolated from direct contact with the gaseous products of combustion, makes a similar double pass through the boiler 10. To this end, system supply piping 46 of the radiator/convector heating system (not shown) directs relatively cool return fluid into a boiler return inlet 48 located in the lower drum 14 adjacent the front end 16' of the lower drum 14. The fluid is heated as it flows in the annular space 24 around the fire-tube 20 in the lower drum 14 toward the rear end 18' of the lower drum 14. As best illustrated in FIG. 4, the fluid flows from the lower drum 14 to the upper drum 12 via a short conduit 50 extending between the drums, 12 and 14, adjacent the fire reversing chamber 32. The fluid is further heated as it flows around each fire-tube 22 from the bottom-rear of the fire-tube bundle 22 to the upper-front of the fire-tube bundle 22. The fully heated fluid exits the boiler 10 at a supply outlet 52 which is located on the upper drum 12 near the front end 16 of the upper drum 12 and which communicates with system supply piping 54 of the radiator/convector heating system.

One unique aspect of the boiler 10 is the configuration of the protective refractory liner 56 of the fire reversing chamber 32. The liner 56 includes a turnaround piece 58 which lines, insulates and protects the rear cover plate 98 and the sidewalls 62 of the reversing chamber 32. However, the turnaround piece 58 of the present invention, as well as the liners disclosed in the patents previously discussed, do not protect the entire reversing chamber including the areas surrounding the first pass fire-tube and the second pass fire-tube bundle. Thus, according to the present invention, a separate saddle insulation piece 64 is utilized to protect the inner wall 66 of the reversing chamber 32 and the weld joints 28 and 38.

Figure 5:
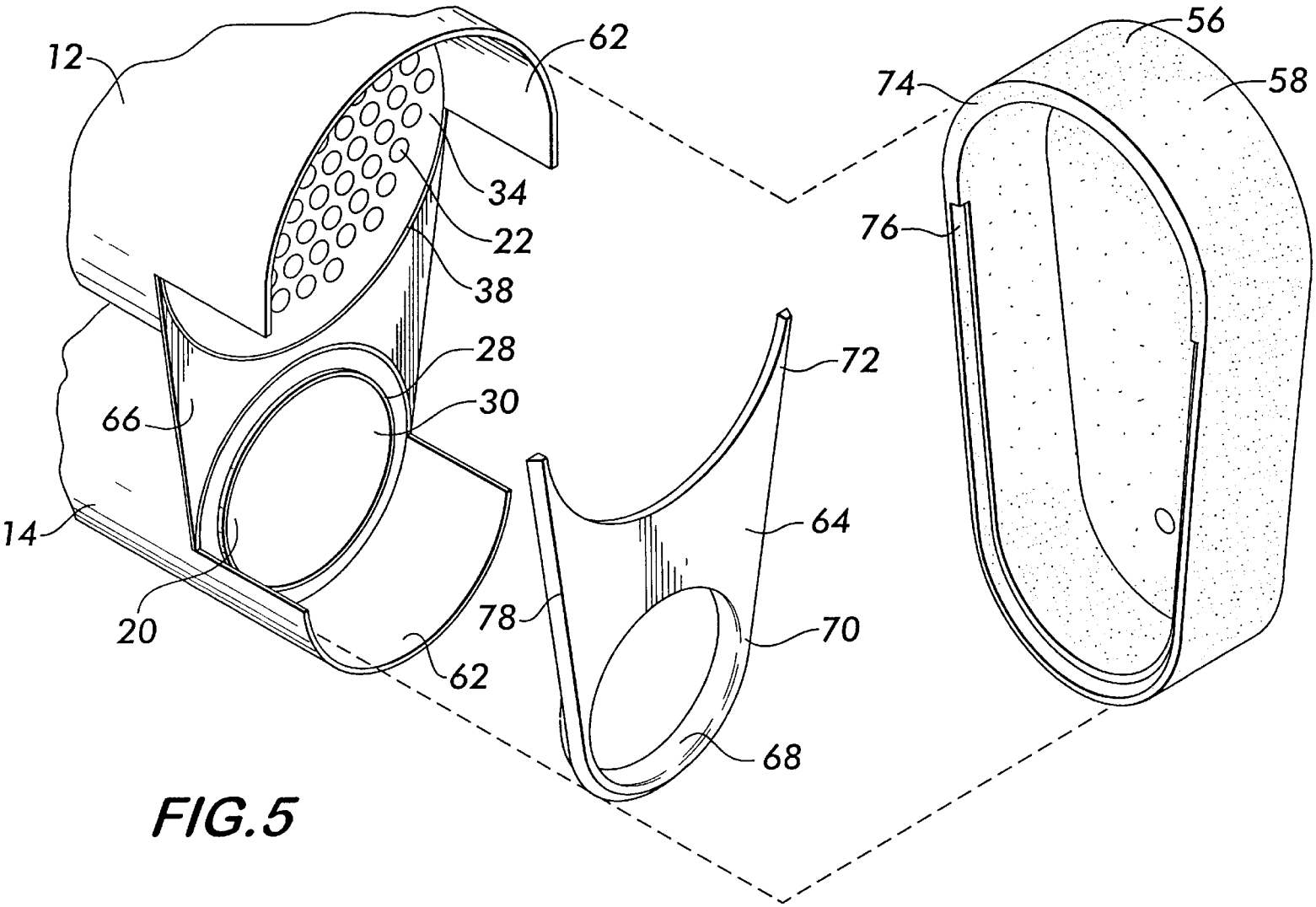
FIG. 5 is an exploded perspective view of a reversing chamber liner according to the present invention.

As best illustrated in FIGS. 4 and 5, the saddle insulation piece 64 lines the inner wall 66 formed by the lower drum 14 and a pertinent portion of the inner wall 66 formed by the upper drum 12 and tubesheet 34. To this end, the saddle insulation piece 64 has an annular flange 68 which cooperatively mates within the end portion 30 of the fire-tube 20 to protect the end portion 30 and to at least initially hold the saddle insulation piece 64 in abutting relation with the inner wall 66. A lower portion 70 of the saddle insulation piece 64 surrounding the annular flange 68 covers and protects the annular weld joint 28 of the fire-tube 20 from radiant heat of the combustion, and an upper portion 72 of the saddle insulation piece 64 covers and protects a portion of the annular weld joint 38 of the tubesheet 34 from radiant heat of the combustion. The turnaround piece 58 covers the remaining portion of the annular weld joint 38 and has a peripheral rim 74 with a notch 76 which mates with an outer edge 78 of the saddle insulation piece 64 to hold the saddle insulation piece in abutting relation with the inner wall 66.

The reversing chamber liner 56 prolongs the life of the boiler 10 by protecting otherwise vulnerable weld joints. The saddle insulation piece 64 may be initially retained in proper position with weld pins (not shown) which, if used, eventually melt away, leaving the turnaround piece 58 to hold the saddle insulation piece 64 in position. Both pieces 58 and 64 of the liner 56 are replaceable and can be manufactured of refractory material such as lightweight vacuum formed ceramic fiber.

Figure 2:
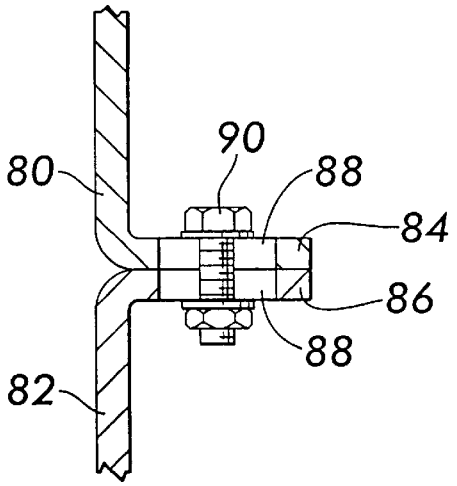
FIG. 2 is a cross-sectional view of a portion of an expansion joint on a front frame of the boiler taken on line 2—2 of FIG. 1.

Another unique aspect of the boiler 10 is the use of an expansion joint between the upper and lower drums to permit unequal thermal expansion of the drums. To this end, as illustrated in FIG. 1, the rear frame 60 is rigidly connected to the rear ends, 18 and 18', of drums, 12 and 14; however, the upper drum 12 is independently connected by a weld joint to an upper frame 80 at front end 16, and the lower drum 14 is independently connected to a lower frame 82 at front end 16'. As best illustrated in FIG. 2, each of the upper and lower frames, 80 and 82, have inwardly projecting flanges, 84 and 86, respectively, which are positioned in abutting relation. The flanges 84 and 86 have a plurality of aligned apertures 88 which permit the frames, 80 and 82, to be fastened together such as with a nut and bolt 90. The apertures 88 are elongate, or slot-like, and are longitudinally-extending with respect to the drums, 12 and 14, so that the connection of the flanges, 84 and 86, is a floating-type of connection which permits a range of relative horizontal movement between the frames, 80 and 82, in the longitudinal direction of the drums, 12 and 14. Thus, an expansion joint is provided which prevents unequal thermal expansion of the drums from generating stress and strain concentrated on the drum-to-frame weld joints.

Another aspect of boiler 10 which can prolong its life is the use of a fluid circulation bypass system. As illustrated in FIG. 1, a bypass pipe 92 extends between the system return piping 46 and system supply piping 54 to enable some of the heated fluid to be combined with the relatively cool return fluid. The bypass performs several functions. First, it ensures high fluid velocities over the first pass fire-tube 20 to improve heat transfer and prevent formation of hot spots. Second, it prevents thermal shocking of the boiler caused by pumping cold system fluid into a hot boiler.

During boiler online operation, fluid continuously circulates through the bypass pipe 92 and through the boiler 10 to minimize the temperature differential between the fluid in the boiler 10 and the fluid in the heating system. On a call for heat, the burner is energized and initiates combustion of gaseous or liquid fuel in the fire-tube 20 as the fluid enters the boiler at the front end 16' of the lower drum 14 and is heated as it travels at a relatively high velocity in the lower drum 14. The gaseous products of combustion reverse direction in the fire reversing chamber 32 and enter the fire-tube bundle 22 in the upper drum 12, while the fluid is propelled through the conduit 50 into the upper drum 12 and across the fire-tube bundle 22. The fluid absorbs additional heat from the fire-tubes 22 as the fluid flows toward the front end 16 of the upper drum 12. The fluid then flows out of the boiler 10 through supply fitting 52 where a predetermined percentage is diverted into the bypass pipe 92 and the difference flows into the system supply piping 54

By way of example and not by way of limitation, the boiler 10 is fabricated of steel except for the liner which is made of a refractory material. The boiler 10 is enclosed by a sheet metal enclosure (not shown), except at the front and rear ends; the second pass fire-tubes are welded, or expanded, to the tubesheets; and the burner is a forced draft retention burner. In addition to the previously described components, the boiler 10 has operating and limiting controls (not shown) such as aquastats, low water cutoff, and safety valves.

In view of the foregoing, it should be readily apparent that the present invention provides a long-lasting boiler. The reversing chamber liner prevents excess radiant heat from reducing the life of vulnerable weld joints; the expansion joint permits unequal thermal expansion between the upper and lower drums and prevents concentration of stresses and strains on framing weld joints; and the use of a bypass circulation system used in combination with the above prevents thermal shocking and prolongs the life of the boiler.

While a preferred embodiment of the present invention has been described in detail, various modifications, alterations, and changes may be made without departing from the spirit and scope of the present invention as defined in the appended claims.

We claim:

1. In a boiler having a first pass fire-tube, a set of second pass fire-tubes held in position by a fire-tubesheet, and means providing a fire reversing chamber connecting said fire-tube passes for reversing the flow of combustion gases between said passes, the improvement comprising:

lower drum and an upper drum centered above said lower drum, said first pass fire-tube being located within said lower drum and said second pass fire-tubes being located within said upper drum, said first pass fire-tube being connected to said lower drum by a fluid tight connection adjacent said fire reversing chamber and said tubesheet being connected to said upper drum by a fluid tight connection adjacent said reversing chamber, and a replaceable refractory liner for lining said fire reversing chamber, said liner also lining an end portion of said first pass fire-tube adjacent said fire reversing chamber and an outer perimeter of said tubesheet, said liner including a saddle piece which lines said connection between said first pass fire-tube and said lower drum and a portion of said connection between said tubesheet and said upper drum.

2. The boiler according to claim 1, wherein said saddle piece has an annular flange which extends within and lines an inner periphery of said end portion of said first pass fire-tube.

3. The boiler according to claim 2, wherein said reversing chamber includes a rear frame having a cover plate facing said first pass fire-tube and said tubesheet, and a sidewall connected to said rear frame to space said cover plate from said said first pass fire-tube and said tubesheet; and wherein said liner includes a turnaround piece for lining said cover plate and said sidewall.

4. The boiler according to claim 3, wherein said turnaround piece engages said saddle piece to hold said saddle piece in position.

5. The boiler according to claim 4, wherein said turnaround piece has a peripheral edge with a notch formed therein to mate with and receive an outer peripheral edge of said saddle piece.

6. The boiler according to claim 5, wherein said turnaround piece and saddle piece of said liner are made from a lightweight, vacuum formed, ceramic fiber.

7. A boiler according to claim 1, further comprising a fluid return inlet located on said lower drum, a fluid supply outlet located on said upper drum, a conduit providing fluid communication between said upper and lower drums, and a bypass pipe adjacent said inlet and outlet and external of said drums for mixing a portion of the fluid flowing out of said outlet with the fluid flowing into said inlet to prevent thermal shocking of said boiler.

8. In a boiler having a first pass fire-tube, a set of second pass fire-tubes held in position by a fire-tubesheet, and means providing a fire reversing chamber connecting said fire-tube passes for reversing the flow of combustion gases between said passes, the improvement comprising:

a lower drum and an upper drum centered above said lower drum, said first pass fire-tube being located within said lower drum and said second pass fire-tubes being located within said upper drum, said upper and lower drums having front ends remote from said fire reversing chamber, and said upper and lower drums being connected at said front ends by an expansion joint which permits unequal thermal expansion of said upper and lower drums; and a replaceable refractory liner for lining said fire reversing chamber, said liner also lining an end portion of said first pass fire-tube adjacent said fire reversing chamber and an outer perimeter of said tubesheet.

9. The boiler according to claim 8, wherein said upper drum is connected to an upper front frame having an inwardly extending flange, said lower drum is connected to a lower front frame having an inwardly extending flange, and said flanges of said upper and lower front frames are positioned in confronting relation, and wherein said flanges have opposed slot-shaped apertures so that said flanges can be bolted together to form said expansion joint, whereby said slot-shape of said apertures permits longitudinal floating between said upper and lower front frames in response to unequal thermal expansion of said upper and lower drums.

10. A boiler for combusting fuel and transferring heat of the combustion to a fluid circulating into and out of the boiler, comprising:

a horizontally-disposed lower drum and a horizontally-disposed upper drum above said lower drum, said drums each having a front end and a rear end, said lower drum having a fluid return inlet adjacent said front end, said upper drum having a fluid supply outlet adjacent said front end, and said upper and lower drums having a fluid connection extending between said drums adjacent said rear end;

a cylindrical first pass fire-tube extending within said lower drum and connected to said lower drum by a fluid tight connection for causing the fluid in said lower drum to surround said first pass fire-tube while fuel is combusted within said first pass fire-tube and the gaseous products of combustion in said first pass fire-tube travels toward said rear end of said lower drum;

a second pass fire-tube bundle extending within said upper drum between a pair of spaced apart tubesheets which are each connected to said upper drum by a fluid tight connection for causing the fluid in said upper drum to surround each fire-tube of said second pass fire-tube bundle;

a fire reversing chamber at said rear end of said drums for receiving gaseous products of combustion from said first pass fire-tube and for directing the gaseous products into said second pass fire-tube bundle in said upper drum; and a replaceable refractory liner for lining said reversing chamber and said fluid tight connections of said first pass fire-tube to said lower drum and of said tubesheet to said upper drum adjacent said reversing chamber, said liner includes a saddle piece which lines said connection between said first pass fire-tube and said lower drum adjacent said reversing chamber and a portion of said connection between said tubesheet and said upper drum adjacent said reversing chamber.

11. The boiler according to claim 10, wherein said saddle piece has an annular flange which extends within and lines an inner periphery of said first pass fire-tube adjacent said reversing chamber.

12. The boiler according to claim 11, wherein said reversing chamber includes a rear frame having a cover plate facing said first pass fire-tube and said tubesheet, and a sidewall connected to said rear frame to space said cover plate from said first pass fire-tube and said tubesheet, and wherein said liner includes a turnaround piece for lining said cover plate and said sidewall and for engaging said saddle piece to hold said saddle piece in position.

13. The boiler according to claim 12, wherein said turnaround piece has a peripheral edge with a notch formed therein to mate with and receive an outer peripheral edge of said saddle piece.

14. The boiler according to claim 13, wherein said upper and lower drums are connected at said front end by an expansion joint which permits unequal thermal expansion of said upper and lower drums.

15. The boiler according to claim 14, wherein said upper drum is connected to an upper front frame having an inwardly extending flange, said lower drum is connected to a lower front frame having an inwardly extending flange, and said flanges of said upper and lower front frames are positioned in confronting relation, and wherein said flanges have opposed slot-shaped apertures so that said flanges can be bolted together to form said expansion joint, whereby said slot-shape of said apertures permits longitudinal floating between said upper and lower front frames in response to unequal thermal expansion of said upper and lower drums.

16. A boiler for combusting fuel and transferring heat of the combustion to a fluid circulating into and out of the boiler, comprising:

a horizontally-disposed lower drum and a horizontally-disposed upper drum above said lower drum, said drums each having a front end and a rear end, said upper and lower drums being connected at said front end by an expansion joint which permits unequal thermal expansion of said upper and lower drums, said lower drum having a fluid return inlet adjacent said front end, said upper drum having a fluid supply outlet adjacent said front end, and said upper and lower drums having a fluid connection extending between said drums adjacent said rear end;

a cylindrical first pass fire-tube extending within said lower drum and connected to said lower drum by a fluid tight connection for causing the fluid in said lower drum to surround said first pass fire-tube while fuel is combusted within said first pass fire-tube and the gaseous products of combustion travel in said first pass fire-tube toward said rear end of said lower drum;

a second pass fire-tube bundle extending within said upper drum between a pair of spaced apart tubesheets which are each connected to said upper drum by a fluid tight connection for causing the fluid in said upper drum to surround each fire-tube of said second pass fire-tube bundle;

a reversing chamber at said rear end of said drums for receiving gaseous products from said first pass fire-tube and for directing the gaseous products into said second pass tube bundle in said upper drum;

said upper drum being connected to an upper front frame having an inwardly extending flange, said lower drum being connected to a lower front frame having an inwardly extending flange, and said flanges of said upper and lower front frames being positioned in confronting relation;

said flanges having opposed slot-shaped apertures so that said flanges can be fastened together to form said expansion joint;

whereby said slot-shape of said apertures permits floating between said upper and lower front frames in response to unequal thermal expansion of said upper and lower drums.

17. The boiler according to claim 16, further comprising a replaceable reversing chamber refractory liner including a saddle piece for lining said connection between said first pass fire-tube and said lower drum adjacent said reversing chamber and a portion of said connection between said tubesheet and said upper drum adjacent said reversing chamber, said saddle piece having an annular flange extending within and lining an inner periphery of said first pass fire-tube adjacent said reversing chamber, said liner also including a turnaround piece having a peripheral edge with a notch formed therein to mate with and receive an outer peripheral edge of said saddle piece to hold said saddle piece in position.

18. A boiler according to claim 17, further comprising an external bypass pipe adjacent said return inlet and supply outlet for mixing a portion of the fluid flowing from said supply outlet with the fluid flowing into said return inlet to prevent thermal shocking of the boiler.

* * * * *